US008979226B2

(12) United States Patent
Abergel et al.

(10) Patent No.: US 8,979,226 B2
(45) Date of Patent: Mar. 17, 2015

(54) SYSTEM AND METHOD FOR DEPOSITING SOLIDIFIABLE TRANSLUCENT FLUID WITH A DETERMINED THICKNESS

(75) Inventors: Edmond Abergel, Paris (FR); Raphael Renaud, Poitiers (FR)

(73) Assignee: MGI France, Ivry sur Seine (FR)

( * ) Notice: Subject to any disclaimer, the term of this patent is extended or adjusted under 35 U.S.C. 154(b) by 945 days.

(21) Appl. No.: 12/949,043

(22) Filed: Nov. 18, 2010

(65) Prior Publication Data

US 2011/0116117 A1 May 19, 2011

(30) Foreign Application Priority Data

Nov. 19, 2009 (FR) ..... 09 05555

(51) Int. Cl.
*B41J 29/38* (2006.01)
*B41J 2/21* (2006.01)

(52) U.S. Cl.
CPC ..... *B41J 2/2114* (2013.01)
USPC ..... 347/6

(58) Field of Classification Search
CPC .... B41J 2/21205; B41J 2/2052; B41J 2/2054; B41J 2/2114
See application file for complete search history.

(56) References Cited

U.S. PATENT DOCUMENTS

| | | | | |
|---|---|---|---|---|
| 2005/0193911 | A1 | 9/2005 | Schneider et al. | |
| 2006/0017761 | A1 | 1/2006 | Matsuzawa | |
| 2007/0076069 | A1* | 4/2007 | Edwards et al. | 347/100 |
| 2009/0322804 | A1 | 12/2009 | Usuda | |
| 2010/0194838 | A1* | 8/2010 | Mitsuzawa | 347/102 |

OTHER PUBLICATIONS

European Search Report from EP 10 19 1399 dated Mar. 22, 2011.
French Search Report from FR 0905555 dated Apr. 12, 2010.

* cited by examiner

*Primary Examiner* — Stephen Meier
*Assistant Examiner* — Renee I Wilson
(74) *Attorney, Agent, or Firm* — Lowe Hauptman & Ham, LLP

(57) ABSTRACT

An ink jet printing system to obtain a finished product comprising a printing station using nozzles with liquid ink for inkjet printing of at least one image on the surface of a suitable substrate. The system also includes at least a first deposit station with nozzles depositing a variable thickness of a solidifying translucent liquid on the substrate surface to produce a finished product without relief, positioned upstream of the drying station of the printed image relative to the direction of movement of the substrate in the system.

7 Claims, 2 Drawing Sheets

Figure 1:
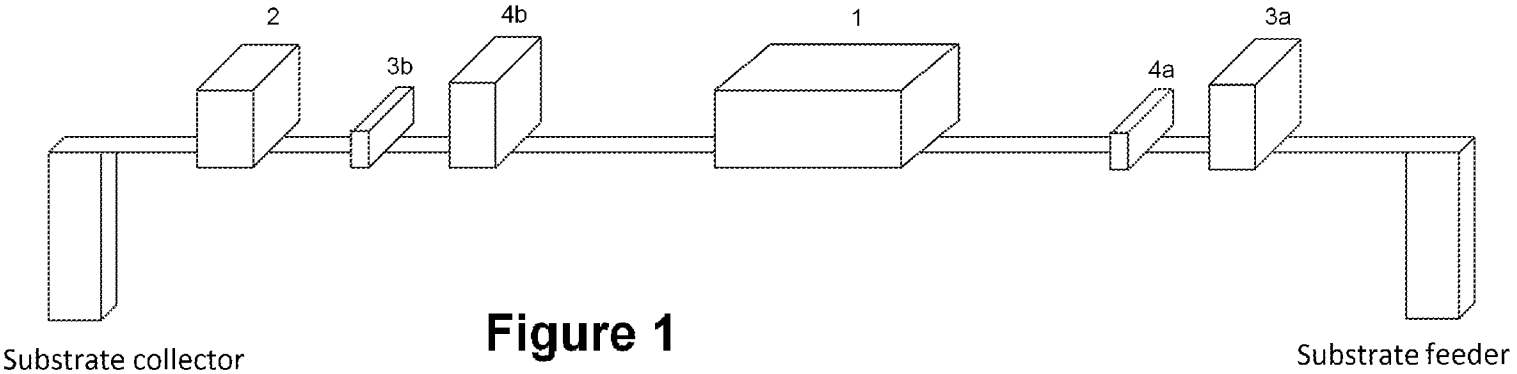

SYSTEM AND METHOD FOR DEPOSITING SOLIDIFIABLE TRANSLUCENT FLUID WITH A DETERMINED THICKNESS

The present invention relates to the field of inkjet printers and more particularly to the field of varnish deposit systems during inkjet printing.

Currently, an Inkjet printing on a so called "closed" surface, such as plastic or certain types of paper, of which the surface is not prepared to receive an impression, poses several problems.

The inkjet deposit requires a thickness of about fifteen microns per color of ink deposited, as opposed to a thickness of five microns in the case of traditional offset printing, which leads to a variation of the thickness of printing of about sixty microns to print in a four color process between a printed region and a non-printed region, resulting in the formation of a relief on the substrate. Moreover, if the printing is done on a "closed" substrate, the ink drops do not penetrate the substrate surface and present an evasive effect by spreading on the substrates surface, which leads to a problem with printing accuracy.

An alternative to circumvent this problem could be to use a paper-type fibrous substrate to obtain a better fixation to the substrate. However, the ink projected through the nozzles is made to penetrate the substrate, which also alters the quality of printing on the substrate. Moreover, by reducing the surface tension of the ink to limit its penetration into the substrate, the ink retains its effect of relief on the surface of the printed substrate.

In offset printing, the ink deposited forms a layer with a thickness in the range of ten microns and leaves on the surface a relief effect, which again is made to penetrate into the substrate when it is absorbent. The document U.S. Pat. No. 7,451,698 proposes an offset print that can be partially covered with a layer of varnish forming a pattern. However, such a printing process, beyond the simple fact that it is not suitable for inkjet printing devices and that it is strictly for aesthetic purpose, does not solve either the problem of the fixing and migration of the ink when printed on a closed substrate, nor the problem of ink absorption when printed on a fibrous paper-type substrate. Such a process does not yield substantial improvements of tactile and visual qualities, of printing of the finished product, especially when the substrate used is a closed substrate.

The present invention aims to resolve one of the drawbacks of known solutions by providing an inkjet printing ink enabling one to dispense with a step treatment of the substrate surface or a supplementary finishing step of the product coming out of the printing machine.

This objective is achieved by a jet printing system for obtaining a finished product comprising:

- a printing station with jet nozzles using liquid printing ink for inkjet printing of at least one image on the surface of a suitable substrate, characterized in that the system also includes:
- at least a first station with jet nozzles for depositing variable thickness of a solidifiable translucent liquid on the surface of the substrate to produce a finished product without relief, positioned upstream to the station for drying the printed image relative to the direction of movement of the substrate in the system.

According to a particular embodiment, the inkjet print system for obtaining a finished product characterized in that the system includes means for controlling the deposit of solidifiable translucent fluid operated by a processing device, taking into account on the one hand the areas not provided with ink and on the other hand the number of colors in the areas provided with ink to determine the thickness of the fluid layer deposited in the considered area so as to obtain the same thickness in areas both provided and not provided with ink.

In a first variant of embodiment, the inkjet printing system for obtaining a finished product is characterized in that the system includes means for controlling the deposit of solidifiable translucent fluid operated by a device for processing image printed or to be printed including an element of conversion of the image to gray scale and a component for calculating the negative of the converted image.

In a second variant of embodiment, the inkjet printing system for obtaining a finished product is characterized in that the printing system includes a second station for depositing, in an area, a thickness of solidifiable translucent fluid controlled in proportion with the thickness of ink that will be subsequently deposited in the area, this station being positioned upstream to the printing station for printing the image on the substrate relative to the direction of movement of the substrate in the system.

According to a particular embodiment, the inkjet printing system for obtaining a finished product is characterized in that the first station for depositing solidifiable translucent fluid is positioned between the printing station for printing the image on the substrate and the station for drying the image printed on the substrate surface.

In another particular embodiment, the inkjet printing system for obtaining a finished product is characterized in that the system includes a processing device of the image printed or to be printed by the printing station in order to determine variation of thickness of the translucent ink deposited by at least one ink depositing station depending on the image printed or to be printed.

In another particular embodiment, the inkjet printing system for obtaining a finished product is characterized in that the jet nozzles of the system are arranged in a ramp and selectively controlled depending on the file of the image printed or to be printed or depending on the file of negative of that image.

In another particular embodiment, the inkjet printing system for obtaining a finished product is characterized in that the jet nozzles of the system are arranged to deposit a solidifiable translucent fluid with a surface tension between 15 and 28 mN/m at 23° C.

In another particular embodiment, the inkjet printing system for obtaining a finished product is characterized in that the system comprises a solidifying station for solidifiable translucent fluid specifically deposited by the second depositing station, upstream to the depositing station for depositing solidifiable translucent fluid relative to the direction of movement of the substrate in the system.

In another particular embodiment, the inkjet printing system for obtaining a finished product is characterized in that the solidifying station makes use of UV radiation to allow a polymerization reaction and/or stiffening of the solidifiable translucent fluid of the printed image and/or of the deposited translucent ink.

Another object of the invention is to provide a method for obtaining a printed product with the finished surface that is without relief.

This objective is achieved by an ink jet printing method for obtaining a finished product with a surface that is exempt from the treatments of the prior art including:

- a step for printing with printing ink at least one image on the surface of a suitable substrate, wherein the method further comprises:

at least one step of depositing a variable thickness of a solidifiable translucent fluid to obtain a finished product with no relief on the surface of the substrate positioned before the step of drying the printed image.

According to a particular embodiment, the inkjet printing method for obtaining a finished product is characterized in that a step of depositing a variable thickness of translucent solidifiable fluid precedes the step of printing the image on the substrate.

According to a particular embodiment, the ink jet printing method for obtaining a finished product is characterized in that the step of depositing a variable thickness of the solidifiable translucent fluid is done following the printing of the image onto the substrate and precedes the step of drying the image printed on the substrate.

According to a particular embodiment, the inkjet printing method for obtaining a finished product is characterized in that the method comprises a step of processing the image printed or to be printed at the printing step so as to define a variation of the thickness of the solidifiable translucent fluid deposited in at least one step of ink depositing depending on the image printed or to be printed.

According to a particular embodiment, the inkjet printing method for obtaining a finished product is characterized in that the processing step takes into account on the one hand the areas not provided with ink and on the other hand the number of colors in the areas provided with ink, to determine the thickness of the layer of fluid deposited in the considered area so as to achieve the same thickness in areas provided and not provided with ink.

According to a particular embodiment, the inkjet printing method for obtaining a finished product is characterized in that the step of processing the image printed or to be printed includes a step of converting the image into grayscale image as well as a step of calculating the negative of the converted image.

According to a particular embodiment, the inkjet printing method for obtaining a finished product is characterized in that at least one step of solidifying the solidifiable translucent fluid deposited succeeds each step of depositing a solidifiable translucent fluid.

According to a variant of embodiment, the inkjet printing method for obtaining a finished product is characterized in that the step(s) of solidifying the solidifiable translucent fluid deposited are made early enough to avoid a spreading of the solidifiable translucent fluid on the printed image to get a product with a mat and/or satin surface.

According to a variant of embodiment, the ink jet printing method for obtaining a finished product is characterized in that the step(s) of solidifying the solidifiable translucent fluid deposited is made once the solidifiable translucent fluid has had enough time to be spread enough over the printed image to get a product with a smooth and/or glossy surface.

Figure 2:
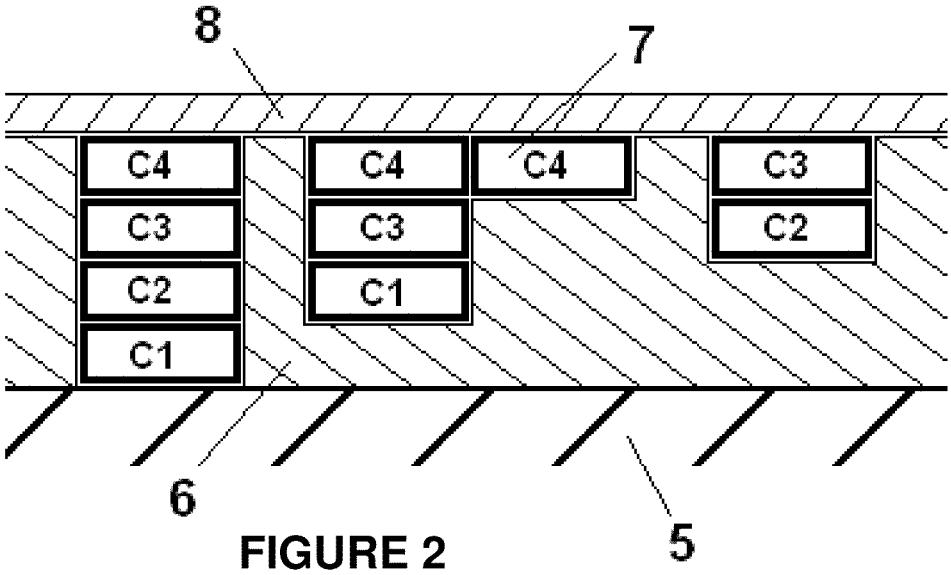
Figure 3:
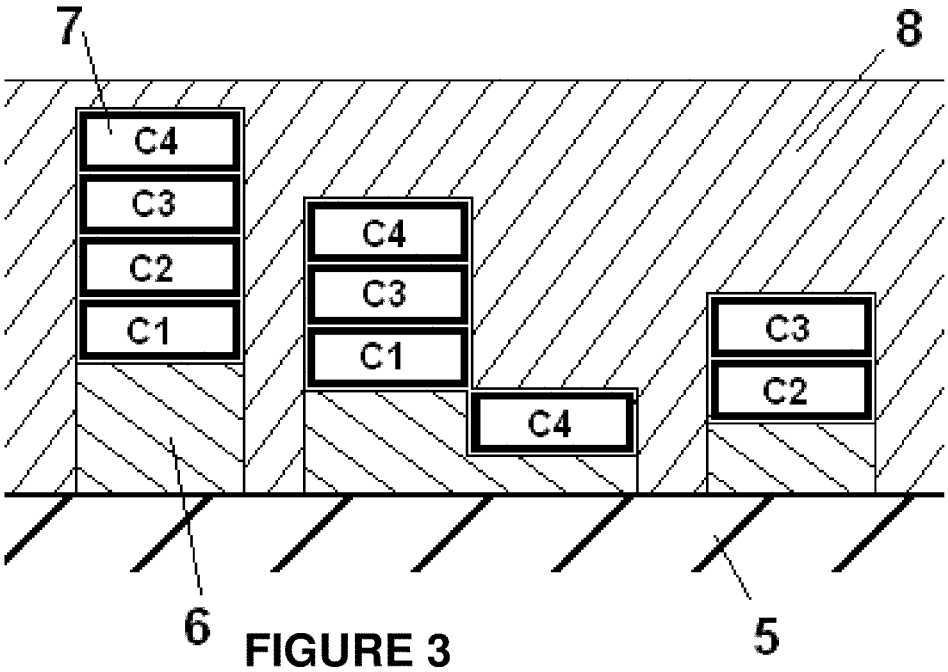

The invention, its features and its advantages will emerge more clearly by reading the description made with reference to the accompanying drawings in which:

FIG. 1 shows a general diagram of a printing system according to the invention, FIG. 2 shows schematically a section representing the deposit layers of a printed product according to a first variant of the method of the invention, FIG. 3 shows schematically a section representing the deposit layers of a printed product according to a second variant of the method of the invention.

It will be appropriate to consider that in this paper, the term "solidifiable translucent fluid" can be applied to varnishes and other viscous transparent products used to overlay substrate surfaces. Solidification of translucent fluid may be operated by heating due to evaporation of one of the constituents of the fluid. However, according to a preferred operating mode, this fluid solidifies by polymerizing at least one of its constituents for example under the effect of ultraviolet radiation. The translucent fluid used has a surface tension between 15 and 28 mN/m at 23° C., preferably between 20 and 28 mN/m, to limit its absorption if any by the substrate (5) to be printed.

These substrates (5) can be, for example and without limitation, non-fibrous base, for example and without limitation, made of plastic, polycarbonate, PVC, polyester, with some flexibility. Such substrates are called closed substrates.

The present invention relates to a printing device in particular for the deposit of translucent ink on the surface of a printed substrate or intended to be printed on so that the finished surface is obtained without relief.

Inkjet Printing Systems that are state of the art in particular include a feeder containing "blank" substrate to be printed, the feeder being located upstream of the system and a collecting device for collecting the substrate when printed located downstream of the system.

According to an embodiment frequently used, the substrate is moved between different successive stations by a means of transport or drive of the substrate, such as a treadmill, or vice versa, by moving the different stations of the printing system over a substrate which remains fixed. Between the feeding of the substrate and the collecting device, the system according to the invention includes an inkjet printing station (1) for printing on the substrate. In one non limiting particular embodiment this printing station (1) is arranged to allow four color process printing of the substrate. This Printing station (1) is associated with a drying station (2) for drying the image printed on the substrate.

Compared with this printing system known to the state of the art, the particularity of the invention is to incorporate at least one depositing station (3*a*, 3*b*) of solidifiable translucent fluid (6, 8) on the substrate (5) so that the step of depositing the translucent fluid (6, 8) is made before the printed substrate (5) undergoes a drying step at a station (2) adapted to this function. In addition, the deposit (3*a*, 3*b*) of solidifiable translucent fluid (6, 8) on the substrate is performed so that the thickness of the translucent ink is variable.

The solidifiable translucent fluid (6) thus deposited forms a relief. However, the relief obtained during the deposit (3) of translucent fluid may be preset and controlled from specific parameters, as explained below in the document. Moreover, according to a particular embodiment, the station (3*a*, 3*b*) for depositing solidifiable translucent fluid on the substrate can be associated with a solidifying station for solidifying (4*a*, 4*b*) the translucent fluid deposited. This solidifying station (4*a*, 4*b*) is then positioned downstream to the depositing station (3*a*, 3*b*) for depositing the translucent fluid (6, 8) relative to the direction of movement of the substrate (5) in the system. Without limitation, the solidifying device (4*a*, 4*b*) used involves UV (ultraviolet) to conduct a polymerization of at least one of the compounds of the solidifying translucent fluid (6) and therefore a stiffening of the ink of the printed image.

Thus, according to a first variant of embodiment, the system according to the invention comprises a first depositing station (3*b*) for depositing a solidifying translucent fluid (6) positioned downstream to the inkjet printing station (1) for ink jet printing on the substrate (5), but upstream to the drying station (2) for drying the printed ink, relative to the direction of movement of the substrate in the system. This particular positioning of the depositing station (3*b*) for depositing the solidifiable translucent fluid (6) allows the coating of the printed substrate by a layer of solidifiable translucent fluid (6) which allows to obtain the desired type of finish for the product as a function of a parameter explained below in the document.

In a second variant of embodiment, the system according to the invention includes a second depositing station (3*a*) for depositing a solidifying translucent fluid (6) positioned upstream to the inkjet printing station (1) for inkjet printing on the substrate (5) relative to the direction of movement of the substrate in the system. This particular positioning of the depositing station (3) for depositing solidifiable translucent fluid (6) allows on one hand to cover the substrate with a layer of fluid (6) whose thickness facilitates the adhesion of the printed image to the substrate (5) at the printing station (1), and on the other hand allows to improve the printing quality thanks to a deposit of solidifiable translucent fluid a relief effect (6), so as to prevent the printing ink (7) from evading.

In both variants of embodiment previously mentioned, deposits of solidifiable translucent fluid (6) are made so that the thickness is variable and allows for removal of all variations of relief on the surface of the substrate (5) that result from ink deposits, for example in a four color process, while printing. Moreover, the coating of the printing of a layer of solidifiable translucent fluid (8) allows one to obtain a printed substrate (5) provided with a surface with no relief and hence to obtain a valued finished product.

According to one particular embodiment, the system according to the invention includes a first station (3*b*) for depositing solidifiable translucent fluid (8) positioned downstream to the inkjet printing station (1) for inkjet printing on the substrate (5) and a second station (3*a*) for depositing solidifiable translucent fluid (6) positioned upstream to the inkjet printing station (1).

The second station (3*a*) for depositing solidifiable translucent fluid (6) allows through a deposit of varying thickness, to overcome variations of the relief of the printed substrate, while the first station (3*b*) for depositing solidifiable translucent fluid (8) allows to make a deposit of surface finish on the product. According to a variant of this embodiment, each of these stations (3*a*, 3*b*) for depositing solidifiable translucent fluid (6, 8) is likely to be associated with a solidifying station (4*a*, 4*b*) respectively.

According to a preferred embodiment, the variation of the thickness of solidifiable translucent fluid (6) deposited on the substrate by the second depositing station (3*a*) is defined from at least one particular parameter. This parameter is the image printed by the printing station. The system, according to the invention, connects the printing station with the solidifiable translucent fluid depositing station(s) (3*a*, 3*b*), either directly or indirectly via a central unit, so that a file of the image printed or to be printed or a processed file of this image is transmitted to the solidifiable translucent fluid depositing stations (3*a*, 3*b*). With a suitable device for the processing of the image printed or to be printed, a map of the surface of the substrate (5) containing different variations of the thickness of solidifiable translucent fluid to be deposited may be established so that the superposition of translucent fluids and printing inks lead to a smooth, flat surface. The processing used preferentially involves a first step of converting the monochrome image, also called grayscale, and a second step of calculating the negative of the image converted. The image obtained after processing corresponds to the negative of the printed image converted to grayscale. The translucent ink deposited on the substrate according to a map corresponding to the image obtained after processing can then compensate for differences in relief of the substrate once it is printed.

According to an alternative method, five files are extracted from the image printed or to be printed. A first file corresponds to a mapping of all points of the image printed or to be printed including all four colors of printing ink. A second file corresponds to a mapping of all points of the image printed or to be printed that includes only three colors of printing ink. A third file corresponds to a mapping of all points of the image printed or to be printed that includes only two colors of printing ink. A fourth file corresponds to a mapping of all points of the image printed or to be printed that includes one color of printing ink. And a final and fifth file corresponds to a mapping of all points of image printed or to be print with no printing ink. From these extracted files, the thickness of translucent ink to be deposited determined by the processing device is inversely proportional to the number of colors in the printing ink used.

The processing steps of the image printed or to be printed are made in a suitable device comprising elements of calculation, conversion and/or appropriate processing for achieving these steps. This suitable device is positioned either in a central unit, connected to multiple stations (1, 2, 3*a*, 3*b*, 4*a*, 4*b*) of the system, that controls the delivery of the finished product, or is positioned at the level of the stations involved in the system.

According to a preferred embodiment, the method used to obtain the valued finished product of the invention also involves a spreading factor of the solidifiable translucent fluid on the printing ink after the depositing of the printing ink. The conservation of this effect during the process can lead to a finished product where the resulting surface is smooth and glossy. This physical phenomenon can be slowed or stopped by the solidifying stations (4*a*, 4*b*), that increase the surface tension and eliminates this possibility of spreading by stiffing the translucent ink deposited. By preventing the spreading phenomenon, the solidification of the solidifiable translucent fluid has thus the advantage of obtaining a finished product whose surface is mat and satin-like. The presence or absence of solidification is therefore particularly important in determining the surface finish of the printed substrate (5).

Moreover, when the solidifying step is performed by the appropriate station (4*a*) prior to the step of printing the image onto the substrate surface, the relief obtained by the thickness variations of translucent ink deposited is more easily maintained to allow compensation of relief created by the deposit of ink (7) during the printing step (1). The variable deposit (3*a*) of solidifiable translucent fluid (6) on the substrate (5) can be carried out according to two different operating modes shown in FIGS. 2 and 3.

According to a first operating mode shown in FIG. 2, the second deposit station (3) of translucent fluid (6) makes a deposit of fluid so that the superposition of the fluid layer (6) deposited and the different layers (c1, c2, c3, c4) of printing ink (7) at the points considered lead to the same thickness over the entire surface of the printed substrate (5). The variation of thickness of the deposited translucent fluid (6) thus forms multiple deposit zones prepared to receive a predetermined number of layers (c1, c2, c3, c4) of printing ink (7). Areas of the substrate surface (5) not intended to be covered with ink thus present the greatest thickness of the translucent fluid. Conversely, the areas provided with four ink colors of the four color process printing present the lowest thickness of fluid (6), even zero thickness. The image obtained during the deposit of solidifiable translucent fluid (6) corresponds to the negative of the image printed or to be printed, converted to grayscale and allows to compensate for differences in relief of the substrate once it it is printed. After printing, the uniform surface of the printed substrate (5) can then be covered with another uniform layer (8) of solidifiable translucent fluid by the first deposit station (3*b*).

In a second operating mode shown in FIG. 3, the second station (3) for depositing translucent fluid (6) makes a deposit of fluid so that the thickness of the layer of fluid (6) deposited is proportional to the number of layers (c1, c2, c3, c4) of printed inks (7) at points considered, regardless of the final thickness with cumulating the thickness of the fluid deposited and the thickness of different layers (c1, c2, c3 c4) of printing ink (7).

Variations of the thickness of the layer of fluid (6) deposited then result in a relief amplified after the deposit step of printing ink (7). The suppression of this relief to obtain a uniform surface is obtained by depositing a second layer of solidifiable translucent fluid (8) with the first deposit station (3*b*), which compensates for variations of relief on the surface of the printed substrate (5).

In both detailed operating modes, variation of thickness of solidifiable translucent fluid (6) deposited allows to define the different ink zones based on the number of layers of ink deposited. The deposit of this fluid layer is usually followed by a solidification of the fluid, the printing ink (7) which is then deposited has a spreading and evasion effect that is reduced or eliminated because of the large surface tension (between 15 and 28 mN/m) of the fluid which categorizes the print areas based on the number of layers (c1, c2, c3, c4) of ink (7) deposited.

It should be obvious to those skilled in the art that the present invention allows embodiments in numerous other specific forms without departing from the scope of the invention as claimed. Therefore, these embodiments should be considered illustrative but can be modified in the field defined by the scope of the appended claims.

The invention claimed is:

1. A method, in which an inkjet printing system is designed to obtain a finished product with a surface treatment, including:

printing with printing ink at least one image on a surface of a suitable substrate, and at least one step of depositing a variable thickness of a solidifiable translucent fluid, the thickness being controlled by a controller as a function of the relief on the surface of the substrate resulting in the deposition of ink during the printing and to get a finished product with no relief on the surface of the substrate, said step of depositing preceding the drying of the printed image.

2. A method of claim 1, wherein the at least one step of depositing a variable thickness of solidifiable translucent fluid precedes the printing with ink the at least one image on the suitable substrate.

3. A method of claim 1, wherein the at least one step of depositing a variable thickness of solidifiable translucent fluid is performed after printing with ink the at least one image on the suitable substrate and precedes the drying the printed image on the suitable substrate surface.

4. A method of claim 1, the method comprises a step of processing the printed image during the printing step so as to define a variation of the thickness of solidifiable translucent fluid deposited in at least one step of ink depositing depending on the image printed or to be printed.

5. A method of claim 4, wherein the processing step takes into account on the one hand the areas not provided with ink and on the other hand the number of colors in areas provided with ink, to determine the thickness of the layer of fluid deposited in the considered area so as to obtain the same thickness in areas provided and not provided with ink.

6. A method of claim 4, wherein the step of processing the image printed or to be printed includes a step of converting the image into grayscale image and a step of calculating a negative of the converted image.

7. A method of claim 1, wherein at least one step of solidifying the solidifiable translucent fluid deposited succeeds each step of depositing a solidifiable transparent fluid.

* * * * *